US008344932B2

(12) United States Patent
Liu

(10) Patent No.: US 8,344,932 B2
(45) Date of Patent: Jan. 1, 2013

(54) RF ANECHOIC CHAMBER

(75) Inventor: Rong-Chung Liu, Dashi Township, Taoyuan County (TW)

(73) Assignee: Emtrek Technologies Corporation, Taoyuan County (TW)

( * ) Notice: Subject to any disclaimer, the term of this patent is extended or adjusted under 35 U.S.C. 154(b) by 227 days.

(21) Appl. No.: 12/779,147

(22) Filed: May 13, 2010

(65) Prior Publication Data

US 2011/0279301 A1 Nov. 17, 2011

(51) Int. Cl.
*H01Q 17/00* (2006.01)

(52) U.S. Cl. ..... 342/1; 342/4

(58) Field of Classification Search ..... 342/1–4
See application file for complete search history.

(56) References Cited

U.S. PATENT DOCUMENTS

| | | | | |
|---|---|---|---|---|
| 4,218,683 | A * | 8/1980 | Hemming | 343/703 |
| 5,134,405 | A * | 7/1992 | Ishihara et al. | 342/1 |
| 5,510,792 | A * | 4/1996 | Ono et al. | 342/4 |
| 6,165,601 | A * | 12/2000 | Noda et al. | 428/215 |
| 2010/0171669 | A1 * | 7/2010 | Ito et al. | 343/703 |

* cited by examiner

*Primary Examiner* — Timothy A Brainard
(74) *Attorney, Agent, or Firm* — Guice Patents PLLC

(57) ABSTRACT

A rectangular RF anechoic chamber, where the material or absorbing material attached to its feeding wall has a homogeneous property on X-Y plane, i.e. the plane parallel to the feeding wall. The MA(s) are mounted on the feeding wall from which the material with a homogeneous property will reduce interferences from the fields which produce scattered fields from the wall; and may produce a quiet zone with significantly improved quality, and specially at low frequency band. Quiet zone quality means the field uniformity in the test zone.

2 Claims, 7 Drawing Sheets

RF ANECHOIC CHAMBER

BACKGROUND OF THE INVENTION

1. Field of the Invention

The present invention relates to rectangular RF anechoic chamber technology and more particularly, to an improved design of rectangular RF anechoic chamber where the material or absorbing material attached to its feeding wall has a homogeneous property on X-Y plane, i.e. the plane parallel to the feeding wall. And the measurement antenna(s) are mounted on the feeding wall from which the material with a homogeneous property will reduce interferences from the fields which produce scattered fields from the wall; and may produce a quiet zone with significantly improved quality, and specially at low frequency band. The quiet zone quality described herein means the field uniformity in the test zone, or the magnitude of ripple of the field strength in the test zone.

2. Description of the Related Art

When testing the radiation pattern and radiation efficiency of an antenna, the radiation power and receiving sensitivity of a wireless apparatus or the RF spurious emission of a device in a RF anechoic chamber, the quality of the quiet zone affects the measurement accuracy directly.

A conventional rectangular RF anechoic chamber 10, as shown in FIG. 1 and FIG. 1A, generally has a pyramidal absorber 13 attached to its feeding wall 12, and one or a number of measurement antennas 14 installed on its feeding wall 12 (see FIG. 1A) or kept at a distance from its feeding wall 12 (see FIG. 1). According to this design, it is difficult to get a high quality quiet zone 15 at low frequencies, for example, below 700 MHz. In order to produce a high quality quiet zone 15 at low frequency band, it is necessary to use a larger size RF anechoic chamber 10 with a larger absorbing materials and to have the electromagnetic fields of MA(s) illuminating the absorbing materials in a smaller off-normal incident angles. When making tests at low frequencies, or selecting an alternative option, a tapered RF anechoic chamber is usually used for the sake of having a better low frequency quiet zone 15. However, a rectangular RF anechoic chamber is easier to construct than a tapered RF anechoic chamber, more particularly under the requirement for a high shielding effectiveness test environment.

Following increasing in low-frequency band applications, such as digital video broadcasting (DVB), very high frequency (VHF) communications and radio-frequency identification (RFID) technology, 4G LTE communications, it is desirable to provide an improved structure of rectangular RF anechoic chamber that improves the measurement accuracy at low frequencies and reduces the cost.

SUMMARY OF THE INVENTION

Under the requirement for a rectangular RF anechoic chamber having a high quality quiet zone for low frequency application, the present invention provides an improved rectangular RF anechoic chamber where the material or absorbing material attached to its feeding wall thereof has a homogeneous property on X-Y plane, i.e., the plane parallel to the feeding wall. The material attached to the other walls has a non-homogeneous property on the plane parallel to its corresponding attached wall. The measurement antenna(s) are mounted on the feeding wall from which the material with a homogeneous property will have no abrupt interferences from the fields that produce scattered fields from the wall. The measurement antenna(s) electromagnetic fields nearby the feeding wall will be guided toward lateral walls and well absorbed by the lateral walls absorbing material in a near normal incident angle which will produce less scattered fields. Therefore, the rectangular RF anechoic chamber can produce a quiet zone with significantly improved quality. More particularly when operating at low frequency band, the absorbing material has a stronger scattering characteristic and a lower absorption capability, showing a significant effect in reducing scattering fields. This design provides a high quality quiet zone at wide operating frequency band including low frequency band. For low frequency application, a smaller rectangular RF anechoic chamber saves much the construction cost.

Other and further benefits, advantages and features of the present invention will be understood by reference to the following specification in conjunction with the accompanying drawings.

DETAILED DESCRIPTION OF THE PREFERRED EMBODIMENT

Figure 3:
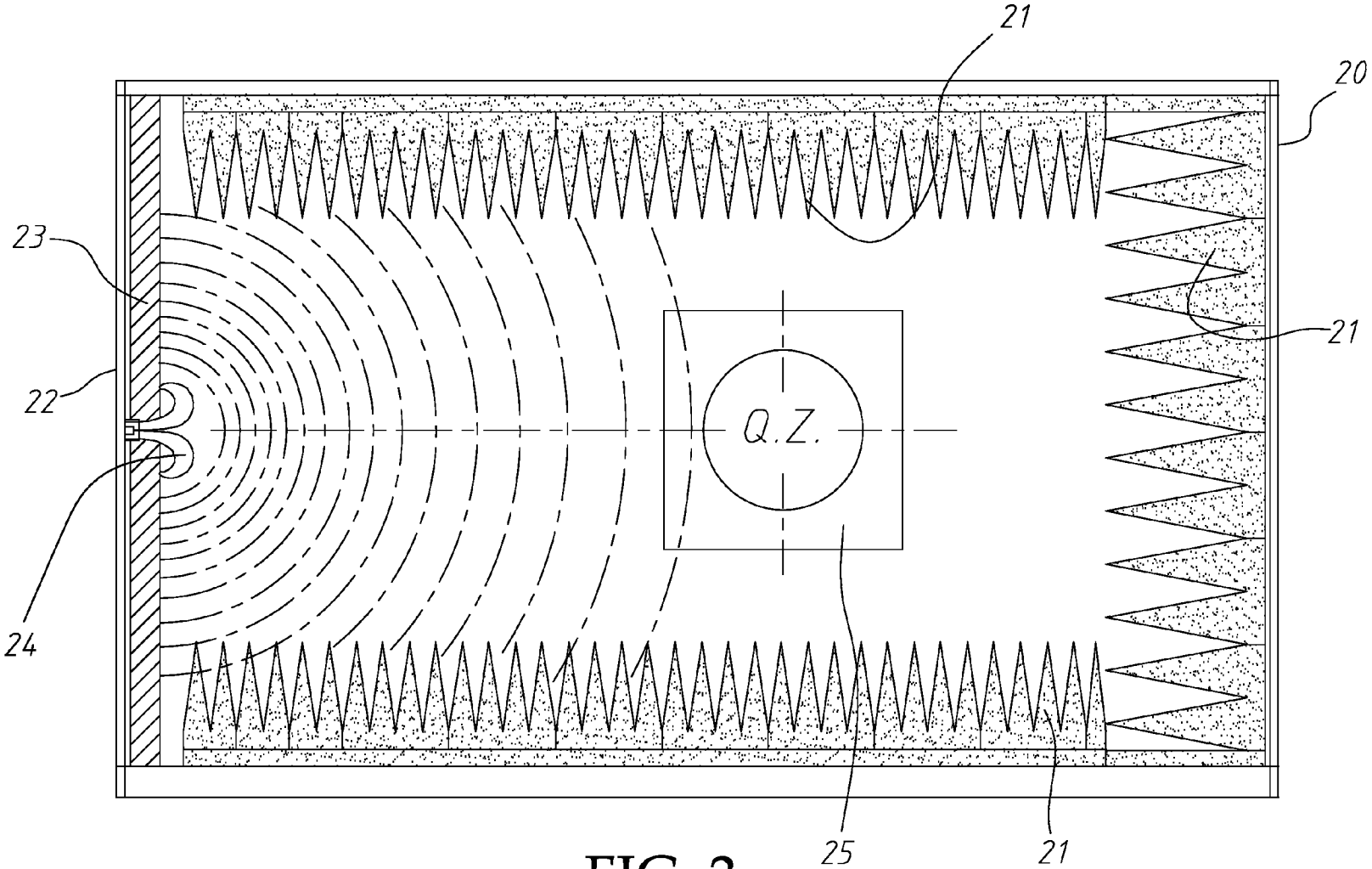
FIG. 3 is a schematic drawing, showing a rectangular RF anechoic chamber constructed according to the present invention.
Figure 3A:
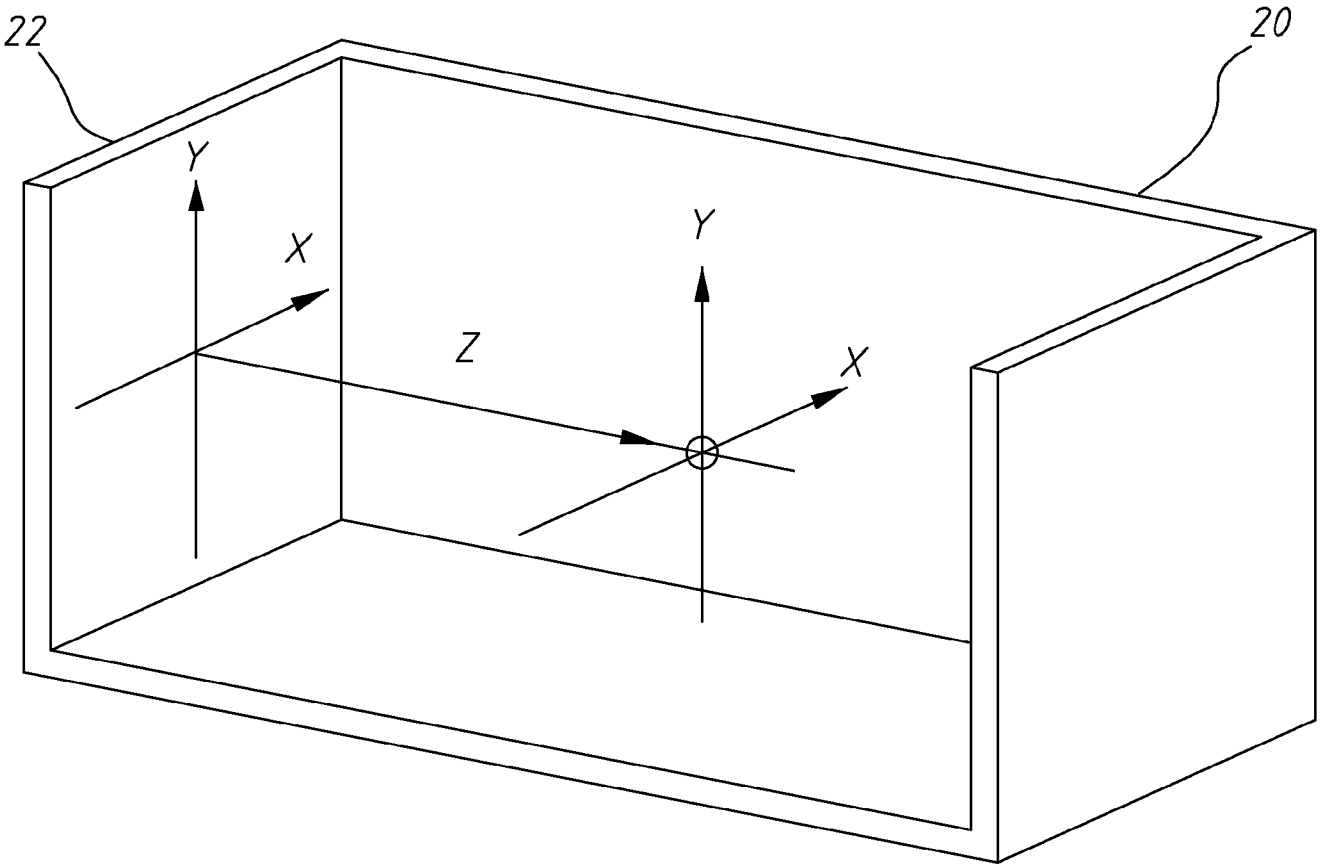
FIG. 3A is a schematic drawing, indicating the XYZ coordinates in the rectangular RF anechoic chamber.

FIG. 3A indicates the XYZ coordinates corresponding to feeding wall 22 in a rectangular RF anechoic chamber 20 constructed according to the present invention. FIG. 3 is a schematic plain view of the rectangular RF anechoic chamber 20 on Y-plane. The material, referenced by 23, that is attached to the feeding wall 22 of the rectangular RF anechoic chamber 20 has a homogeneous property on X-Y plane. The measurement antennas (s), referenced by 24, are mounted on the feeding wall 22. The absorbing material attached to the other walls of the rectangular RF anechoic chamber 20 has a non-homogeneous property on the plane parallel to each corresponding attached wall. As shown in FIG. 3, the non-homogeneous material 21 has a pyramidal shape.

By means of arranging the feeding wall 22 of the rectangular RF anechoic chamber 20 the attached material 23 that has a homogeneous property on X-Y plane, the electromagnetic fields produced by the measurement antenna(s) 24 will not cause scattering from the feeding wall, means no interference source from the feeding wall and the nearby MA(s) electromagnetic fields are reflected, guided to lateral walls in a near normal incident angle being well absorbed, thereby improving the field strength uniformity in the quiet zone 25. Thus, no requirement having a larger chamber to decrease the interference sources, the size of the rectangular RF anechoic chamber 20 can be minimized to provide an optimal low-frequency test environment, facilitating cost down.

Figure 1:
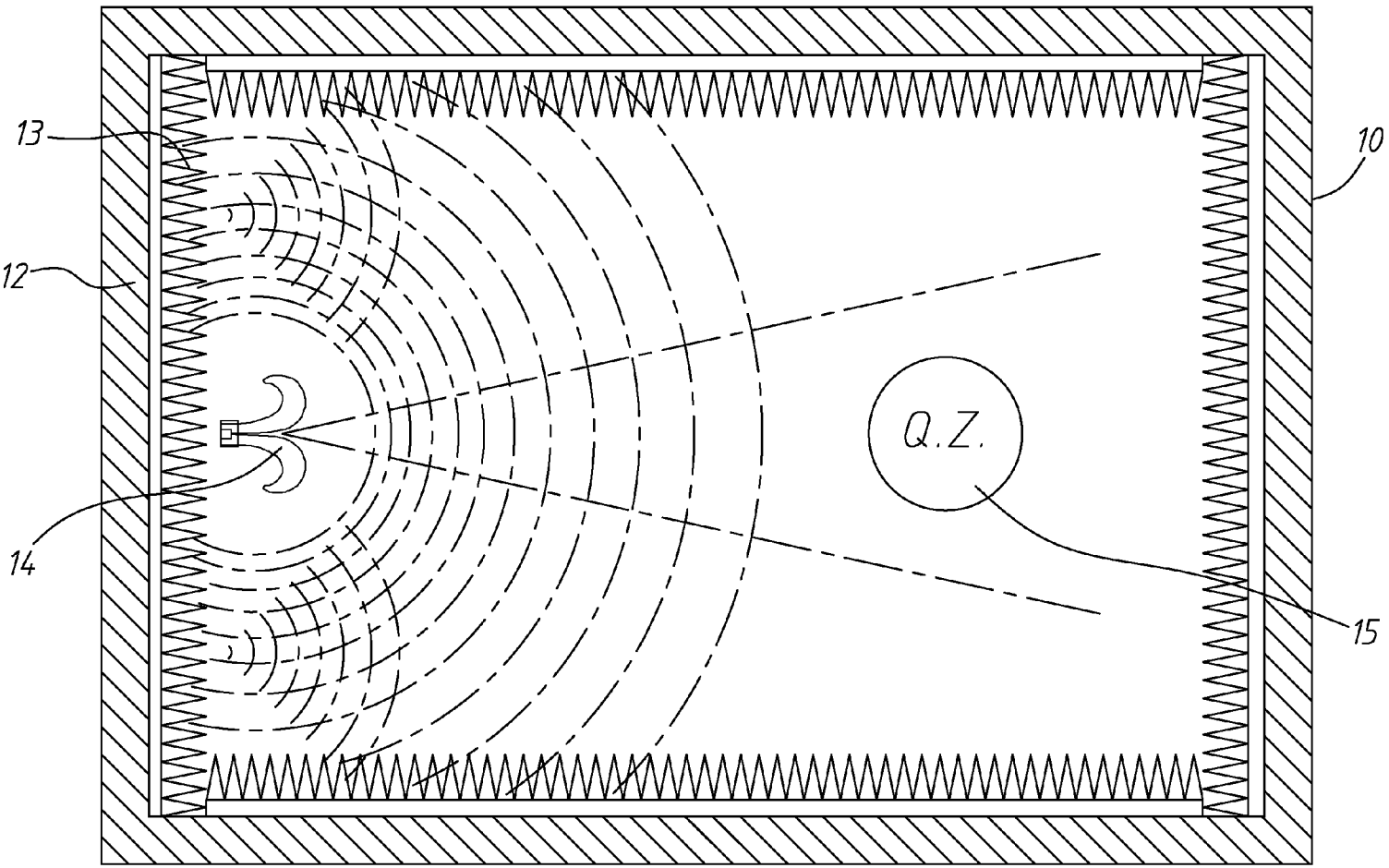
FIG. 1 PRIOR ART
FIG. 1 is a schematic drawing of a rectangular RF anechoic chamber according to the prior art, showing the measurement antennas spaced from the feeding wall at a distance.
Figure 1A:
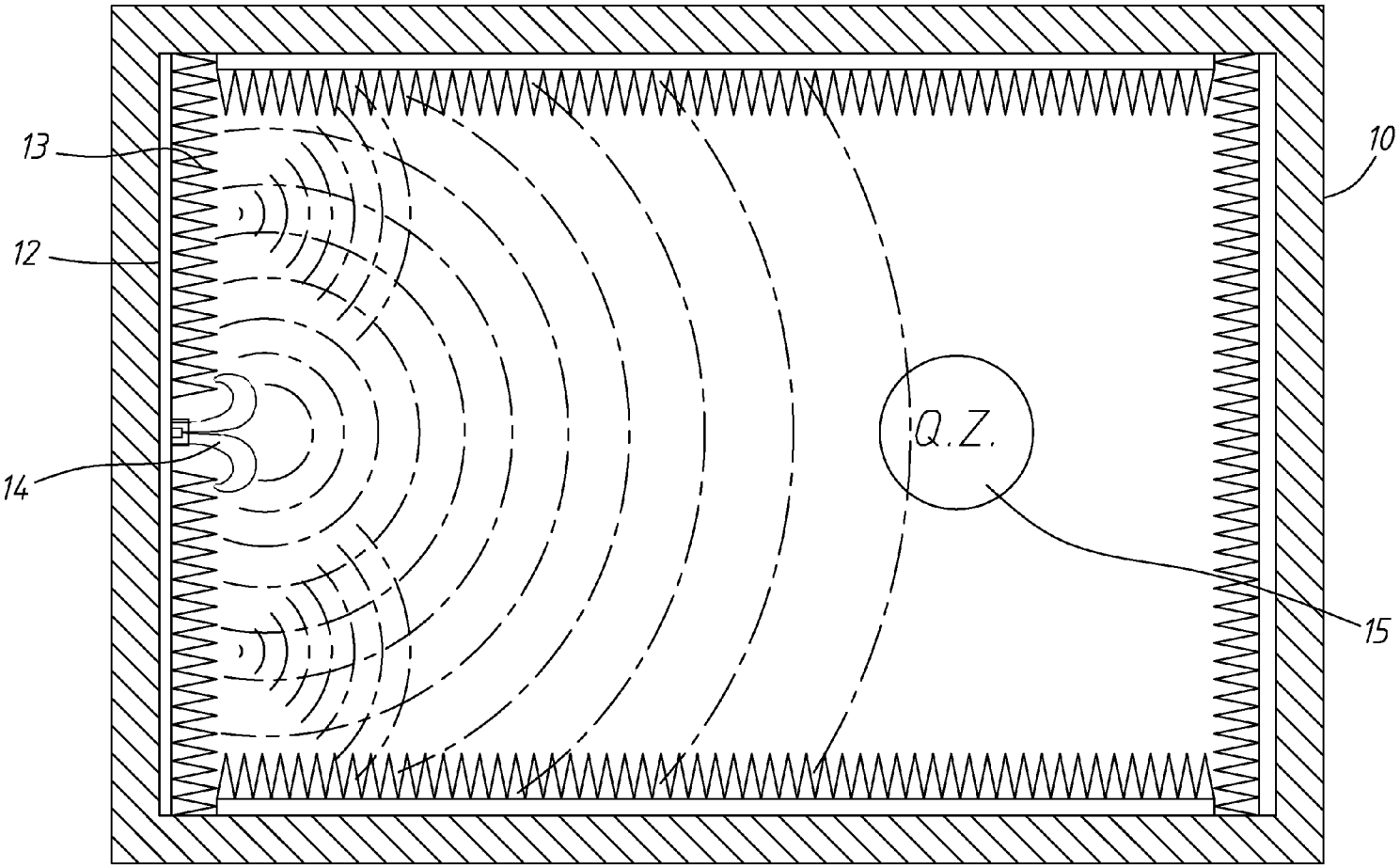
FIG. 1A PRIOR ART
FIG. 1A is similar to FIG. 1 but showing the measurement antennas mounted on the feeding wall.
Figure 2:
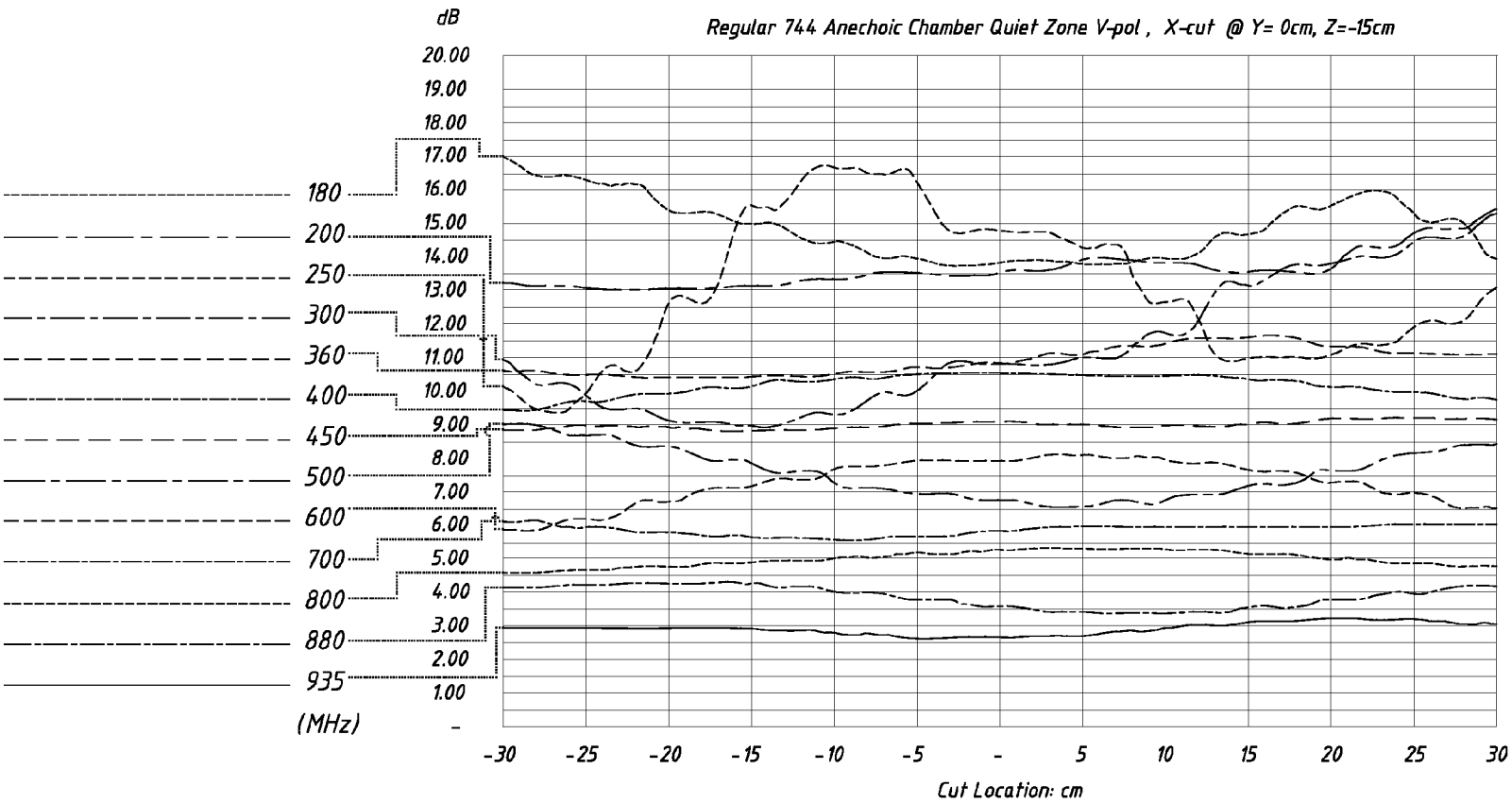
FIG. 2 PRIOR ART
FIG. 2 illustrates test results obtained from a prior art rectangular RF anechoic chamber at different frequencies.
Figure 4:
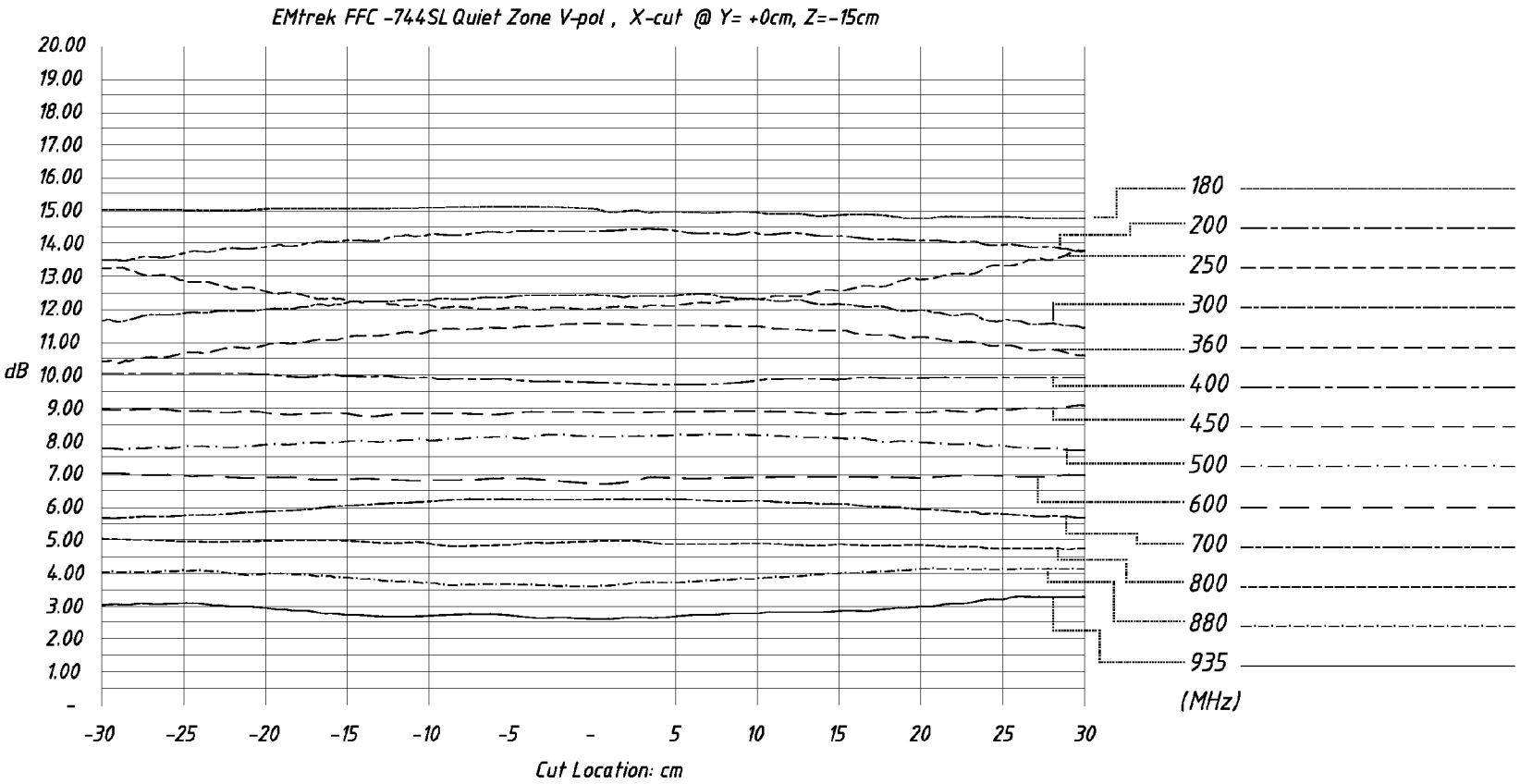
FIG. 4 illustrates test results obtained from the rectangular RF anechoic chamber at different frequencies according to the present invention.

The test results exhibited in FIG. 4 show that the invention can produce a high quality quiet zone 25 for low frequency application (the size of the RF anechoic chamber shown in FIG. 4 is 650 cm*385 cm*385 cm; the size of the prior art RF anechoic chamber shown in FIG. 2 is 715 cm*365 cm*365 cm).

Figure 5:
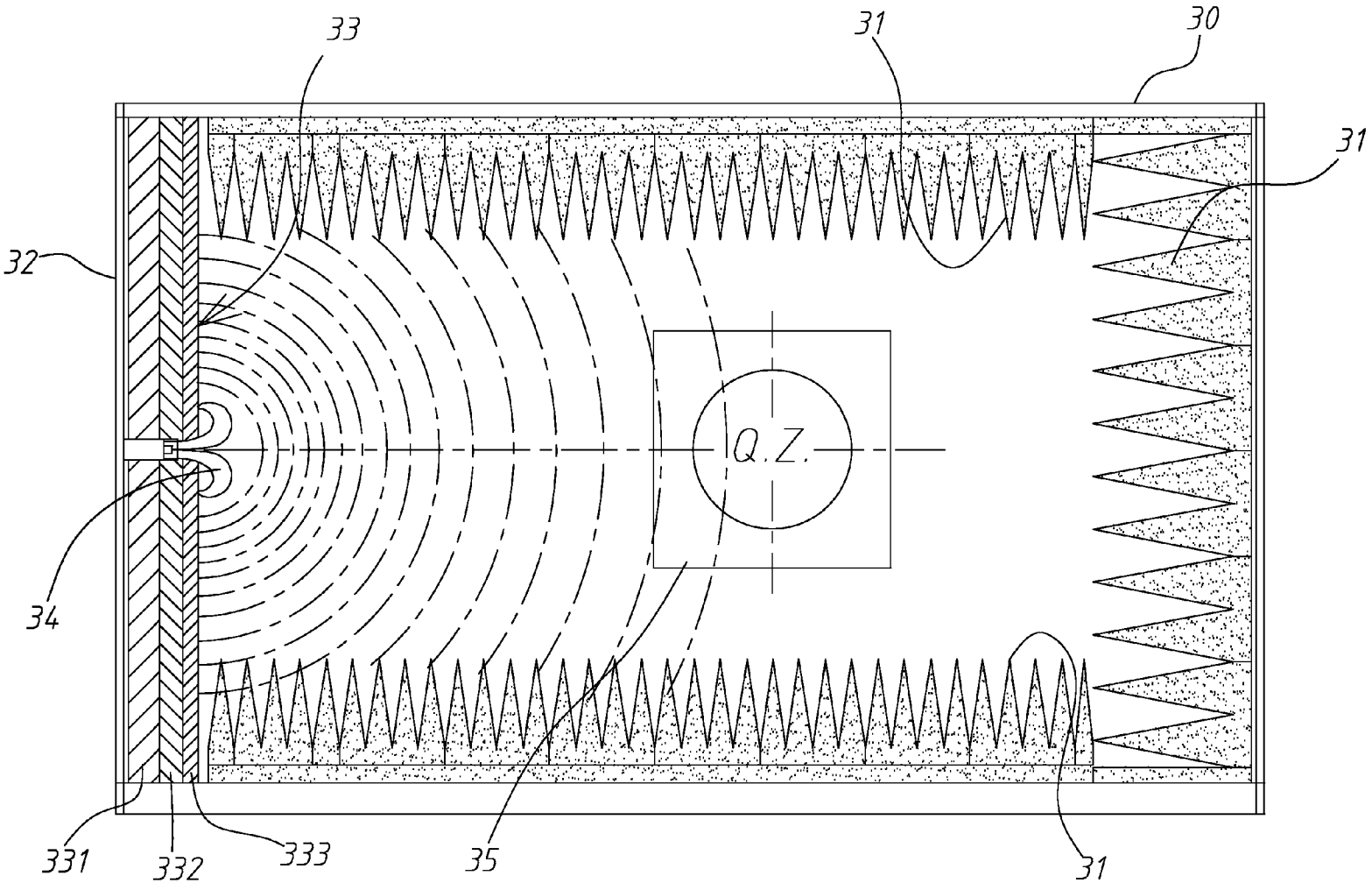
FIG. 5 is a schematic drawing showing an alternate form of the rectangular RF anechoic chamber according to the present invention.

FIG. 5 shows an alternate form of the present invention. According to this embodiment, the rectangular RF anechoic chamber 30 is substantially similar to the embodiment shown in FIG. 3, comprising a feeding wall 32, a material 31 having a non-homogenous property on a plane parallel to the corresponding attached walls, a material 33 having a homogeneous property on a plane parallel to the feeding wall 32, and measurement antennas 34. However, the material 23 having a homogeneous property on a plane parallel to the feeding wall 22 and having a homogeneous property on the z-direction, as shown in FIG. 3, is a flat absorber; the material 33 having a homogeneous property on a plane parallel to the feeding wall 32 but having a non-homogeneous property in the z-direction, as shown in FIG. 5, is a laminated absorber having multiple layers 331, 332 and 333. Further, the material 31 having a non-homogeneous property parallel to the attached wall can be a combination of pyramidal and wedge type absorber and other type materials. This design greatly improves the quality of the quiet zone 35 for low frequency test. Further, the material having a homogeneous property on a plane parallel to the feeding wall can be air.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A RF anechoic chamber comprising:

an interior bounded by a feeding wall and other walls;

a material attached to an interior surface of said feeding wall thereof and having a homogenous property on an X-Y plane parallel to said feeding wall, at least one measurement antenna; and absorbing materials attached to interior surfaces of the other walls thereof respectively and having a non-homogenous property on planes parallel to each corresponding attached walls;

wherein the material having the homogenous property located on the feeding wall and the absorbing material having the non-homogenous property located on the other walls are the innermost surfaces of the RF anechoic chamber;

wherein the material with homogenous property is a flat absorber.

2. A RF anechoic chamber comprising:

an interior bounded by a feeding wall and other walls;

a material attached to an interior surface of said feeding wall thereof and having a homogenous property on an X-Y plane parallel to said feeding wall, at least one measurement antenna; and absorbing materials attached to interior surfaces of the other walls thereof respectively and having a non-homogenous property on planes parallel to each corresponding attached walls;

wherein the material having the homogenous property located on the feeding wall and the absorbing material having the non-homogenous property located on the other walls are the innermost surfaces of the RF anechoic chamber;

wherein the material with homogenous property is a laminated absorber.

* * * * *